US010550593B2

(12) United States Patent
Lauletta et al.

(10) Patent No.: US 10,550,593 B2
(45) Date of Patent: Feb. 4, 2020

(54) DEBRIS SEPARATING POOL SKIMMER

(71) Applicants: Mia G. Lauletta, Sewell, NJ (US); Frank A. Lauletta, Sewell, NJ (US)

(72) Inventors: Mia G. Lauletta, Sewell, NJ (US); Frank A. Lauletta, Sewell, NJ (US)

( * ) Notice: Subject to any disclaimer, the term of this patent is extended or adjusted under 35 U.S.C. 154(b) by 0 days.

(21) Appl. No.: 15/905,069

(22) Filed: Feb. 26, 2018

(65) Prior Publication Data

US 2019/0264457 A1 Aug. 29, 2019

(51) Int. Cl.
*E04H 4/12* (2006.01)

(52) U.S. Cl.
CPC ..... *E04H 4/1272* (2013.01); *E04H 4/1245* (2013.01)

(58) Field of Classification Search
CPC ..... E04H 4/1272; E04H 4/1245
USPC ..... 210/167.1, 167.12, 167.19, 400
See application file for complete search history.

(56) References Cited

U.S. PATENT DOCUMENTS 6,029,290 A * 2/2000 Butcher ..... E03F 5/14 210/167.14
8,241,506 B1 * 8/2012 Vernier ..... E04H 4/1254 210/167.12
2018/0251993 A1 * 9/2018 Irvine ..... E04H 4/16

* cited by examiner

*Primary Examiner* — Fred Prince
(74) *Attorney, Agent, or Firm* — Lauletta Birnbaum LLC

(57) ABSTRACT

A debris separating pool skimmer having a chamber. The chamber includes wet and substantially dry cavities. The first wet cavity has an inlet in fluid communication with the pool and a water outlet disposed on a bottom. The second substantially dry cavity is disposed behind the wet cavity. An upstanding wall extends from a bottom wall of the chamber to separate the wet and dry cavities and prevents water in the wet cavity from flowing into the substantially dry cavity. A separator is disposed within the chamber that transports debris and/or animals from the wet cavity into the dry cavity such that debris and/or animals are stored in the dry cavity and are prevented from blocking the water outlet of the wet cavity.

19 Claims, 3 Drawing Sheets

DEBRIS SEPARATING POOL SKIMMER

STATEMENT REGARDING FEDERALLY SPONSORED RESEARCH OR DEVELOPMENT

The present invention was not developed with the use of any Federal Funds, but was developed independently by the inventors.

BACKGROUND

Field

The Invention relates to water skimmers, and more particularly to a pool skimmer which collects any large debris that can clog a skimmer/filter basket which can create more strain on the pump, which is safe for animals caught within the skimmer, and which may incorporate a wet chamber containing a pool of water for the purpose of skimming off surface water of the pool and a substantially dry chamber for the collection of debris and the safe storage of animals caught within the skimmer. Exemplary of installations with which the skimmer may be used are swimming pools, and well as hot tubs, spas, or the like.

A major problem which exists with swimming pools, both commercial and residential, is keeping such pools dean. Dust, dirt and other foreign matter enters the water and settles on the bottom of the pool. In addition, leaves, bugs, feathers and other debris accumulate on the water and ultimately become saturated and sink to the bottom. Modern swimming pools all employ recirculating pump systems for withdrawing water from drains located at the bottom and from skimmers located at the water surface. This water then passes through a filter which removes suspended particles from the water prior to returning the water to the pool after it has been filtered. Water circulation pumps for achieving this purpose operate for extended periods of times, in some cases continuously, throughout the life of the pool. In some systems, chemicals, such as chlorine, are injected into the return water for the pool, either prior to or after filtering of the water has been effected.

Systems have been developed for causing "automatic" cleaning of pools. Existing cleaning systems, however, do not have a capability of handling leaves and similar debris. As a result, the conventional leaf skimmer continues to be a necessary part of any pool system. Leaf skimmers typically are located in a well or cavity adjacent the pool and have an inlet which is partially submerged and partially above the normal water level for the pool. The inlet has a one way pivoted floating dam in it to permit water and leaves to pass into the leaf skimmer, but the dam prevents leaves and other surface debris from passing out of the skimmer into the pool. To cause surface water to move from the pool into the skimmer, the recirculation pump normally withdraws at least a portion of the water for recirculation and filtering from the bottom of the skimmer in addition to water withdrawn from the drain in the bottom of the pool. Consequently, the water which flows through the recirculating pump is pulled through the skimmer and the skimmer leaf basket on a continuous basis.

As leaves, animals, and other debris are pulled into the leaf basket, they tend to plug up the openings in the basket and restrict the water flow through it. It is necessary to periodically empty the leaf basket to prevent substantial restriction of the water flow through it. If the leaf basket is not emptied frequently, it is possible to completely or significantly block water flow through the basket to the recirculating pump, causing the recirculation operation to be impaired. If all of the return water were to be withdrawn through a conventional leaf skimmer, it would be possible to restrict the water flow to such an extent that damage to the pump could exist. For that reason, most pool systems cause the water withdrawn from the pool by the pump to be pulled both from the leaf skimmer and from the drain at the bottom of the pool.

Another problem is that animals that are pulled into the skimmer often get caught in the skimmer basket and drown due to the constant suction of the pump drawing water from the bottom of the skimmer. Moreover, once the animal has drowned, its body quickly decomposes due to the water pressure of the pump.

Thus, it is desirable to provide a leaf skimmer which has all the advantages of conventional leaf skimmers, but which does not interfere in any way with the recirculating water flow through the pump and filter system. In addition, it is further desirable to provide a leaf skimmer that protects animals that inadvertently get caught in the skimmer. Furthermore, it is desirable to provide such a leaf skimmer at little or no additional cost over conventional leaf skimmers currently employed with swimming pools.

Accordingly, there is a need for a new and improved pool skimmer which facilitates easy removal of debris which may interfere with the easy circulation of water within the skimmer and which is safe for animals that may become caught within the skimmer.

SUMMARY

Disclosed herein is a debris separating pool skimmer having a chamber. The chamber includes wet and substantially dry cavities. The first wet cavity has an inlet in fluid communication with the pool and a water outlet disposed on a bottom. The second substantially dry cavity is disposed behind the wet cavity. An upstanding wall extends from a bottom wall of the chamber to separate the wet and dry cavities and prevents water in the wet cavity from flowing into the substantially dry cavity. A separator is disposed within the chamber that transports debris and/or animals from the wet cavity into the dry cavity such that debris and/or animals are stored in the dry cavity and are prevented from blocking the water outlet of the wet cavity.

In one form of the invention the separator is a powered conveyor belt that transports debris and/or animals from the wet cavity to the dry cavity. The conveyor belt may include a surface having a plurality of openings therethrough which permit water to flow through the openings to the outlet of the wet cavity while preventing larger debris and/or animals from passing therethrough. A pair of driveshafts around which the conveyor belt is secured may also be provided, one of the drive shafts is power to rotate the conveyor belt and conveyor debris and/or animals on a top surface of the conveyor belt from the wet cavity into the dry cavity. The front of the conveyor belt may be disposed at or below a water level of the wet cavity and a back of the conveyor belt located closer to the dry cavity is disposed above the front of the conveyor belt presenting an upwardly inclined surface upon which debris and/or animals travel. Alternately, one of the driveshafts may be located at a front of the dry cavity closest to the inlet and is disposed at or below a water level of the wet cavity and the other of the driveshafts may be located at a back of the conveyor belt closer to the dry cavity and is disposed above the front of the conveyor belt presenting an upwardly inclined surface upon which debris and/or animals travel.

In one form of the invention the skimmer chamber may include at least one opening at a top of the chamber to access one of both of the wet and dry cavities.

BRIEF DESCRIPTION OF THE DRAWINGS

The embodiments will be described in detail with reference to the following drawings in which like reference numerals refer to like elements wherein.

DETAILED DESCRIPTION

Figure 1:
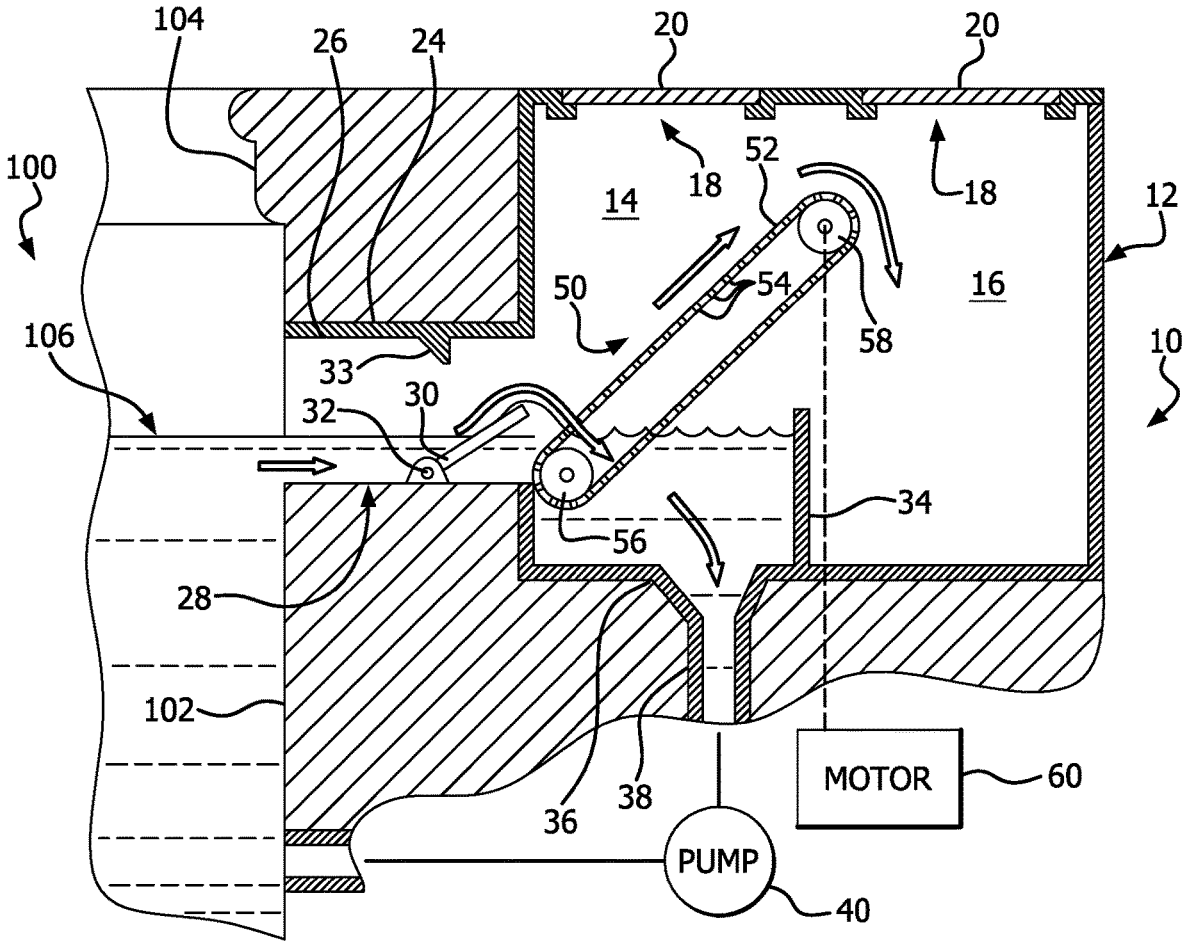
FIG. 1 shows a side cross-sectional view of a pool skimmer in accordance with the present invention.
Figure 2:
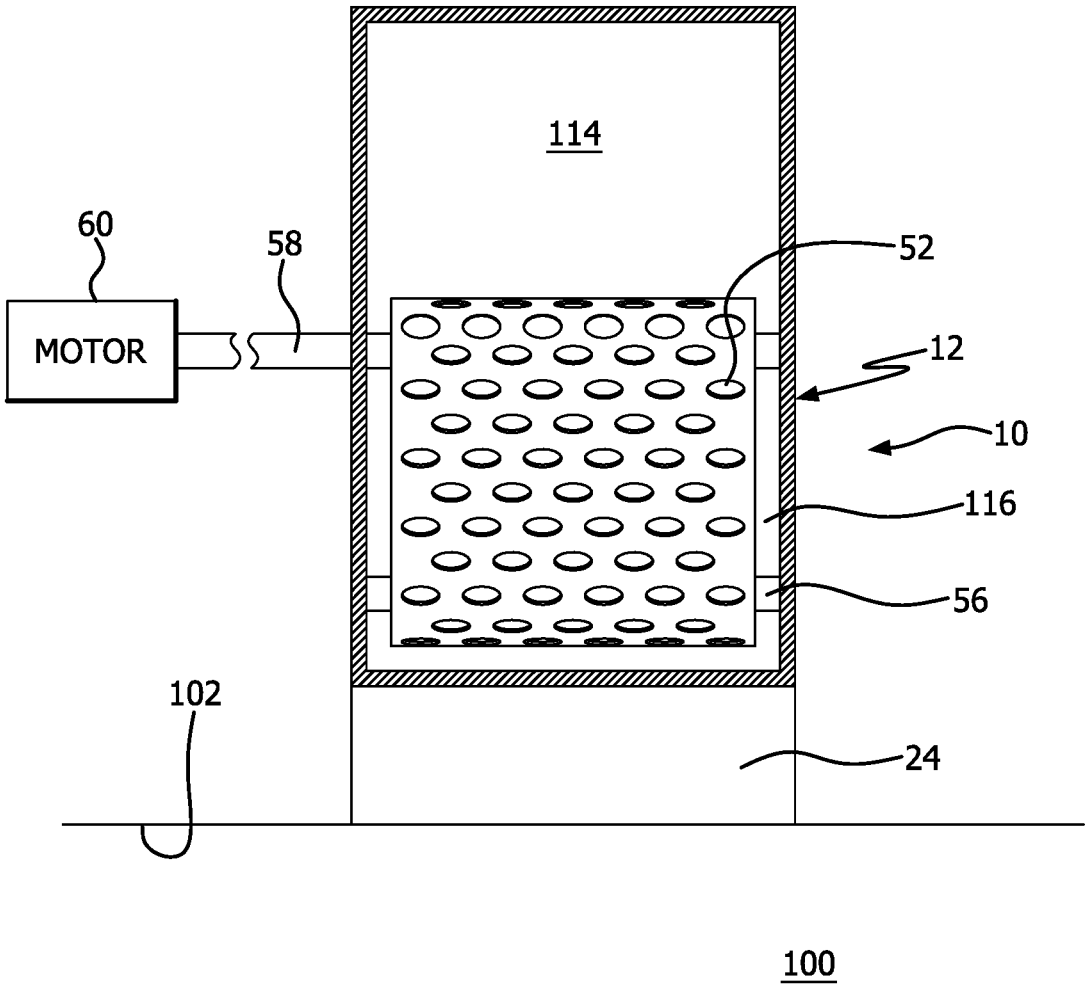
FIG. 2 shows a top view of the pool skimmer of FIG. 1.

Reference now should be made to the drawings in which like reference numbers are used throughout the different figures to designate the same or similar components. FIG. 1 illustrates, in cross section, a preferred embodiment of the invention employed in conjunction with a standard swimming pool 100. A portion of the swimming pool is illustrated in the form of the upper part of one of the vertical walls 102 which has a covering or coping 104 around its periphery to minimize the splashing of water out of the pool. Water in the pool typically is maintained at a level 106, as illustrated. A skimmer 10 made in accordance with the invention, is in the form of an elongated cavity 12 having a first wet chamber or cavity 14 and a second substantially dry chamber or cavity 16. The cavity 12 is located a short distance from the wall 102 and typically formed in the concrete which is used to form the wall 102 of the pool. One or more openings 18 supporting a cover or lid 20 are also provided, such as for the wet and dry cavities 14 and 16, respectively. In normal use, the lid(s) 20 are in place; but it is made to be easily removable for access the wet and dry chambers 14 and 16 within the skimmer 10.

A water level inlet 24 is provided between the first wet chamber 14 of the skimmer and the pool 100. This inlet extends through the wall 102 and is located so that the water level 106 of the pool typically falls somewhere midway between the upper wall 26 and the lower wall 28 of the inlet 24. This is illustrated in FIG. 1.

The inlet 24 typically includes a floating dam 30, pivoted at its lower end on a pivot 32 for permitting water, leaves and other floating debris to pass from the pool into the inlet 24 over the dam 30 and into the first cavity 14 in the direction of the arrows shown. When waves are created in the pool, any reverse water flow which might take place causes the dam 30 to pivot counter-clockwise, as viewed in FIG. 1, to abut the projection 33, preventing debris from being withdrawn from the skimmer and returned to the pool.

The dry cavity 16 is disposed behind the first wet cavity 14 and further away from the inlet opening 24 into the pool 100. The first wet cavity 14 and the second dry cavity 16 of the skimmer 10 are separated by an upstanding wall 34 which extends from the bottom 36 of the chamber 12 to above the water level 106, as shown. The upstanding wall 34 prevents pool water from flowing from the wet cavity 14 into the substantially dry cavity 16, maintaining substantially dry conditions for any animals and/or debris deposited thereinto.

Water is withdrawn from the bottom 36 of the cavity 14 through a return line 38 and is supplied through the recirculating pump 40 of the pool. To accomplish this, a pump 40 for the swimming pool withdraws water for the pool 100 from the skimmer 10 through return line 38 as well as other suitable below-water drains and return line(s). Ultimately the filtered water is pumped back into the pool 100 through spaced water jets located along the side wall(s) 102 of the pool 100.

In lieu of a conventional skimmer basket, the skimmer of the present invention is provided with a separator 50, such as a conveyor belt 52 that is formed from any suitable water-resistant material, such as a thermoplastic molded material or rubber. The separator 50 is centrally located within the wet cavity 14. The separator is designed to selectively permit water from the inlet 24 to pass through, while simultaneously preventing debris from passing therethrough. In this respect, the conveyor belt may be formed with a plurality of openings 54 through the conveyor belt material sized and spaced to approximate the openings formed in a skimmer basket.

The separator 50 comprises a pair drive shafts 56 and 58 upon which the conveyor belt 52 is disposed around, as shown. One of the conveyor shafts is power by a motor 60 to rotate the conveyor belt 52 as shown. The motor may be powered by any suitable force, such as electric, water pressure, solar powered, and the like. The front drive shaft 56 is located near the front of the cavity 14 below water level 106 while the back shaft 58 is located above the upstanding wall 37 and above the water level 106. This arrangement presents an inclined conveyor belt surface for any debris entering the skimmer through the inlet 24. The conveyor belt is rotated such that debris and/or animals are transported up the front conveyor belt surface and out of the water. In this way debris and/or animals too large to pass through the openings 54 in the conveyor belt 52 are guided by the movement of the conveyor belt 52 out of the first wet chamber 14 and are disposed into the second dry chamber 16 out of harm's way, in the case of animals.

Figure 3:
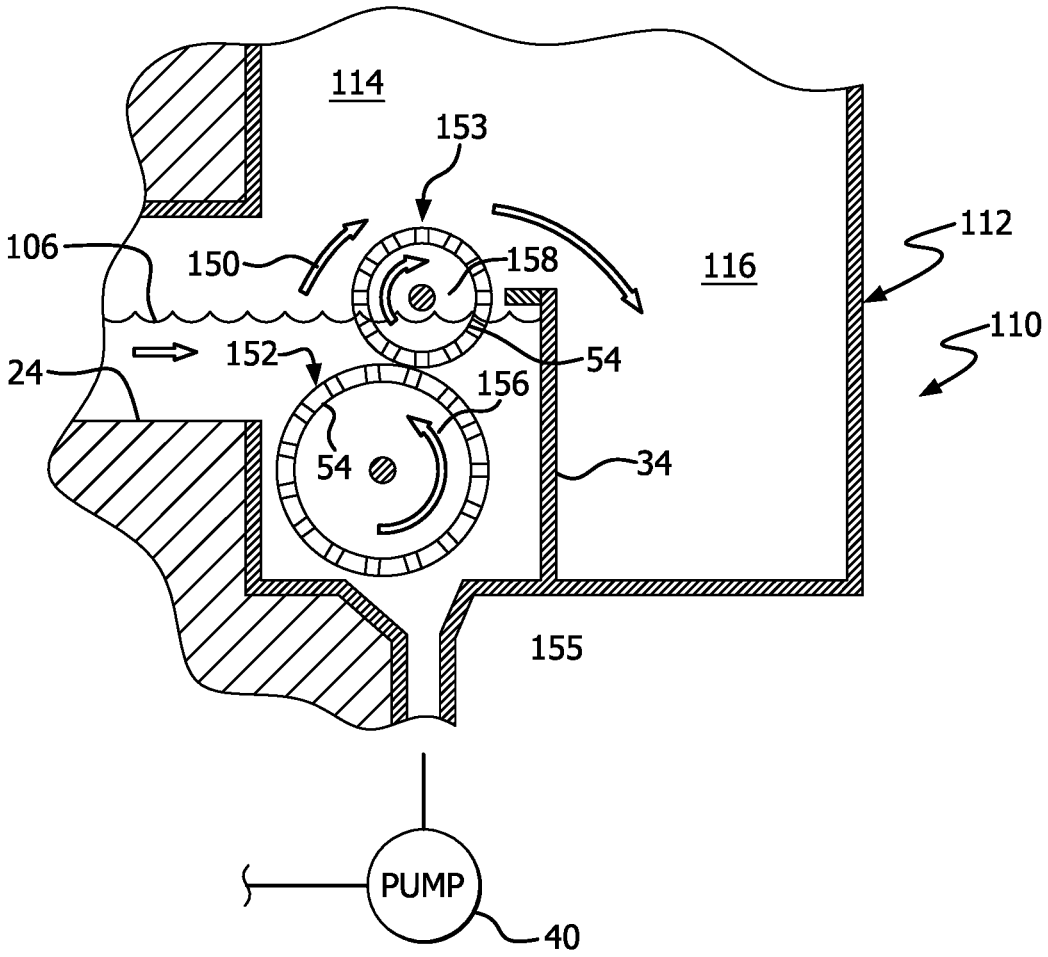
FIG. 3 shows a side cross-sectional view of an alternate embodiment of the pool skimmer in accordance with the present invention.

FIG. 3 shows another embodiment of the present invention in which like reference numerals depict like elements. In this embodiment, the skimmer 100 is disposed in chamber 112 is provided with a separator 150, such as an upper conveyor belt 152 that is rotatable contact with a lower conveyor belt 153. The separator 150 is centrally located within the wet cavity 114. The separator is designed to selectively permit water from the inlet 24 to pass through, while simultaneously preventing debris from passing therethrough.

The separator 150 comprises a pair shafts 156 and 158 upon which the conveyor belt 152 and 153 are disposed around, as shown. The motor may be powered by any suitable force, such as water pressure caused by the water suction caused by pump 40 which causes water to flow over and through conveyor belt 152. The rotation of conveyor 152 is in contact with conveyor belt 153 causing conveyor belt 153 to rotate as shown. The front drive shaft 156 is located near the front of the cavity 114 below water level 106 while the back shaft 158 is located adjacent or above the upstanding wall 37 and above the water level 106. This arrangement presents a belt surface for transporting any debris entering the skimmer through the inlet 24. The conveyor belt is rotated such that debris and/or animals are transported up the front conveyor belt surface and out of the water, out of the first wet chamber 114 and are disposed into the second dry chamber 116 out of harm's way, in the case of animals.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A debris separating pool skimmer comprising:

a chamber, the chamber comprising a first wet cavity having an inlet in fluid communication with a pool and a water outlet disposed on a bottom; and a second substantially dry cavity disposed behind the wet cavity; and an upstanding wall extending from a bottom wall of the chamber to separate the wet and dry cavities, the upstanding wall preventing water in the wet cavity from flowing into the substantially dry cavity; and a separator disposed within the chamber that transports debris and/or animals from the wet cavity into the dry cavity whereby debris and/or animals are stored in the dry cavity and prevented from blocking the water outlet of the wet cavity.

2. The debris separating pool skimmer according to claim 1 wherein the separator is a powered conveyor belt that transports debris and/or animals from the wet cavity to the dry cavity.

3. The debris separating pool skimmer according to claim 2 wherein the conveyor belt comprises a surface having a plurality of openings therethrough which permit water to flow through the openings to the outlet of the wet cavity while preventing larger debris and/or animals from passing therethrough.

4. The debris separating pool skimmer according to claim 2 wherein the separator further comprises a pair of driveshafts around which the conveyor belt is secured, one of the drive shafts being powered to rotate the conveyor belt and conveyor debris and/or animals on a top surface of the conveyor belt from the wet cavity into the dry cavity.

5. The debris separating pool skimmer according to claim 3 wherein the separator further comprises a pair of driveshafts around which the conveyor belt is secured, one of the drive shafts being powered to rotate the conveyor belt and conveyor debris and/or animals on a top surface of the conveyor belt from the wet cavity into the dry cavity.

6. The debris separating pool skimmer according to claim 2 wherein a front of the conveyor belt is disposed at or below a water level of the wet cavity and a back of the conveyor belt closer to the dry cavity is disposed above the front of the conveyor belt presenting an upwardly inclined surface upon which debris and/or animals travel.

7. The debris separating pool skimmer according to claim 3 wherein a front of the conveyor belt is disposed at or below a water level of the wet cavity and a back of the conveyor belt closer to the dry cavity is disposed above the front of the conveyor belt presenting an upwardly inclined surface upon which debris and/or animals travel.

8. The debris separating pool skimmer according to claim 4 wherein one of the driveshafts is located at a front of the dry cavity which is closest to the inlet and is disposed at or below a water level of the wet cavity and the other of the driveshafts is located at a back of the conveyor belt closer to the dry cavity and is disposed above the front of the conveyor belt presenting an upwardly inclined surface upon which debris and/or animals travel.

9. The debris separating pool skimmer according to claim 5 wherein one of the driveshafts is located at a front of the dry cavity which is closest to the inlet and is disposed at or below a water level of the wet cavity and the other of the driveshafts is located at a back of the conveyor belt closer to the dry cavity and is disposed above the front of the conveyor belt presenting an upwardly inclined surface upon which debris and/or animals travel.

10. The debris separating pool skimmer according to claim 1 further comprising at least one opening at a top of the chamber to access one of both of the wet and dry cavities.

11. The debris separating pool skimmer according to claim 2 further comprising at least one opening at a top of the chamber to access one of both of the wet and dry cavities.

12. The debris separating pool skimmer according to claim 9 further comprising at least one opening at a top of the chamber to access one of both of the wet and dry cavities.

13. The debris separating pool skimmer according to claim 1 wherein the separator comprises a separate lower water-powered conveyor belt which is in contact with an upper conveyor belt that transports debris and/or animals from the wet cavity to the dry cavity.

14. The debris separating pool skimmer according to claim 13 wherein the conveyor belts comprise a surface having a plurality of openings therethrough which permit water to flow through the openings to the outlet of the wet cavity while preventing larger debris and/or animals from passing therethrough.

15. The debris separating pool skimmer according to claim 14 wherein the lower conveyor is disposed below a water level of the wet cavity and the upper conveyor is disposed at or above the water level at a back of the wet cavity closer to the dry cavity.

16. The debris separating pool skimmer according to claim 1 wherein the chamber is defined by a top wall, the bottom wall, and a side wall that extends from the bottom wall to the top wall to form an enclosure, the wet and dry cavities being formed within the enclosure.

17. The debris separating pool skimmer according to claim 16 wherein the side wall comprises a plurality of side walls.

18. The debris separating pool skimmer according to claim 16 wherein the separator is disposed within the enclosure, the separator having a top that is located below the top wall of the chamber.

19. The debris separating pool skimmer according to claim 17 wherein the separator is disposed within the enclosure, the separator having a top that is located below the top wall of the chamber.

* * * * *